US009839988B2

(12) United States Patent
Kondo et al.

(10) Patent No.: US 9,839,988 B2
(45) Date of Patent: Dec. 12, 2017

(54) BLAST PROCESSING DEVICE AND BLAST PROCESSING METHOD

(71) Applicant: Fuji Jukogyo Kabushiki Kaisha, Tokyo (JP)

(72) Inventors: Yoshihiko Kondo, Sano (JP); Hirotsugu Takazawa, Sano (JP); Manabu Saito, Tokyo (JP); Tatsuo Nakahata, Tokyo (JP); Hisayuki Oode, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 14/341,403

(22) Filed: Jul. 25, 2014

(65) Prior Publication Data

US 2015/0044946 A1 Feb. 12, 2015

(30) Foreign Application Priority Data

Aug. 8, 2013 (JP) ..... 2013-165625

(51) Int. Cl.

| | |
|---|---|
| ***B24C 3/32*** | (2006.01) |
| ***B24C 7/00*** | (2006.01) |
| ***B24C 3/02*** | (2006.01) |
| ***B24C 3/04*** | (2006.01) |

(52) U.S. Cl.

CPC ..... *B24C 3/32* (2013.01); *B24C 3/02* (2013.01); *B24C 3/04* (2013.01); *B24C 7/0053* (2013.01)

(58) Field of Classification Search

CPC ..... B24C 3/32; B24C 7/0053; B24C 3/02
See application file for complete search history.

(56) References Cited

U.S. PATENT DOCUMENTS

| | | | | |
|---|---|---|---|---|
| 2,846,820 | A | 8/1958 | Persak et al. | |
| 4,218,855 | A * | 8/1980 | Wemmer | 451/102 |
| 4,249,956 | A * | 2/1981 | Hartman | B08B 7/0071 134/38 |
| 5,319,894 | A * | 6/1994 | Shank, Jr. | 451/102 |
| 6,165,053 | A * | 12/2000 | Yokokawa et al. | 451/53 |
| 6,402,593 | B1 * | 6/2002 | Shaw | B24C 1/04 451/102 |
| 6,464,570 | B1 * | 10/2002 | Shaw et al. | 451/102 |

(Continued)

FOREIGN PATENT DOCUMENTS

| | | |
|---|---|---|
| JP | 07-052046 | 2/1995 |
| JP | 2002-120153 | 4/2002 |

(Continued)

OTHER PUBLICATIONS

Extended European search report dated Oct. 20, 2014, in European Patent Application No. 14/179,568.2.

(Continued)

*Primary Examiner* — Dung Van Nguyen
(74) *Attorney, Agent, or Firm* — Smith, Gambrell & Russell, LLP

(57) ABSTRACT

A blast processing device includes a first nozzle, a second nozzle, and a moving mechanism. The first nozzle blasts a blasting material toward a workpiece, using first compressed air. The second nozzle blasts second compressed air for adjusting a diffusion range of the blasting material. The moving mechanism moves the first nozzle and the second nozzle over the workpiece.

18 Claims, 4 Drawing Sheets

(56) References Cited

U.S. PATENT DOCUMENTS

| | | | | |
|---|---|---|---|---|
| 9,302,368 | B2 | 4/2016 | Keiji | |
| 2011/0028075 | A1* | 2/2011 | Hiraga | B24C 1/08 451/102 |
| 2011/0104991 | A1 | 5/2011 | O'Donoghue et al. | |

FOREIGN PATENT DOCUMENTS

| | | | |
|---|---|---|---|
| JP | 2008-140610 | A | 6/2008 |
| JP | 2010-064194 | | 3/2010 |
| JP | 2013-052457 | A | 3/2013 |
| JP | 2013-129021 | | 7/2013 |
| WO | WO 2009/112945 | | 9/2009 |

OTHER PUBLICATIONS

Japanese Office Action dated Aug. 22, 2017, in Japanese Patent Application No. 2013-1654625 (6 pages including machine translation).

* cited by examiner

BLAST PROCESSING DEVICE AND BLAST PROCESSING METHOD

CROSS-REFERENCE TO RELATED APPLICATIONS

The present application claims priority from Japanese Patent Application No. 2013-165625 filed on Aug. 8, 2013, the entire contents of which are hereby incorporated by reference.

BACKGROUND

1. Technical Field

The present invention relates to a blast processing device and a blast processing method.

2. Related Art

Blast processing is known conventionally as a surface processing technique in which hard particles are blasted by compressed air so as to impinge on a surface of a workpiece such as a machined component or a painted component. With blast processing, rust and dirt on the surface of the workpiece can be removed. Blast processing is therefore used mainly as priming processing performed during painting or the like, and surface processing such as paint stripping and shot peening.

Blast processing is performed by blasting a blasting material toward a workpiece together with compressed air from a blast processing nozzle. A conventional blast processing nozzle is configured by providing a conical deflecting member that widens toward the workpiece side on one end of a cylindrical flow passage pipe that is open at both ends. The blasting material is blasted along a surface of the conical deflecting member in a 360 degree direction and a diagonal direction (see Japanese Unexamined Patent Application Publication (JP-A) Nos. 2010-64194 and H7-52046, for example).

A shot peening device having a flattened or angular tube-shaped cross-section, in which a tubular diffusing member that widens toward a workpiece is provided on a tip end of a cylindrical nozzle and a triangular flat plate-shaped diffusing body is provided inside an open end of the tubular diffusing member, has also been proposed (see JP-A No. 2002-120153, for example). With this device, a width of a peening range formed from a combination of rectangular regions can be adjusted. Further, an angle of a shot direction on an identical plane to an axial direction of the nozzle, or in other words a rotation angle of the shot direction about a single axis, can be adjusted.

Furthermore, a blast processing nozzle in which a blasting material blasting region is formed as an anisotropic region in accordance with a shape of a workpiece by partially blocking a circular blasting port so that a surface of a columnar component having an H-shaped, I-shaped, L-shaped, T-shaped, or other cross-section can be blasted efficiently has been devised (see JP-A No. 2013-129021, for example).

When a plurality of surfaces are blasted simultaneously, it is important to blast the blasting material onto the workpiece more efficiently and under more favorable conditions. For example, components of an aircraft include a stringer having an I-shaped cross-section, and the I-shaped stringer must be primed prior to painting. The I-shaped stringer has three orthogonal surfaces on either side. It is therefore important to blast the three orthogonal surfaces under conditions that are more favorable for priming.

SUMMARY OF THE INVENTION

An object of the present invention is therefore to provide a blast processing device and a blast processing method with which a plurality of surfaces can be blasted simultaneously under more favorable conditions.

An aspect of the present invention provides a blast processing that includes a first nozzle, a second nozzle, and a moving mechanism. The first nozzle blasts a blasting material toward a workpiece, using first compressed air. The second nozzle blasts second compressed air for adjusting a diffusion range of the blasting material. The moving mechanism moves the first nozzle and the second nozzle over the workpiece.

A second aspect of the present invention provides a blast processing method to manufacture a blasted product, using the blast processing device described above.

A third aspect of the present invention provides a blast processing method that includes: blasting a blasting material toward a workpiece from a first nozzle using first compressed air; blasting second compressed air from a second nozzle to adjust a diffusion range of the blasting material; and manufacturing a blasted product by moving the first nozzle and the second nozzle over the workpiece.

DETAILED DESCRIPTION

Hereinafter, implementations of the present invention will be described with reference to the drawings.

(First Implementation)

(Configuration and Functions)

Figure 1:
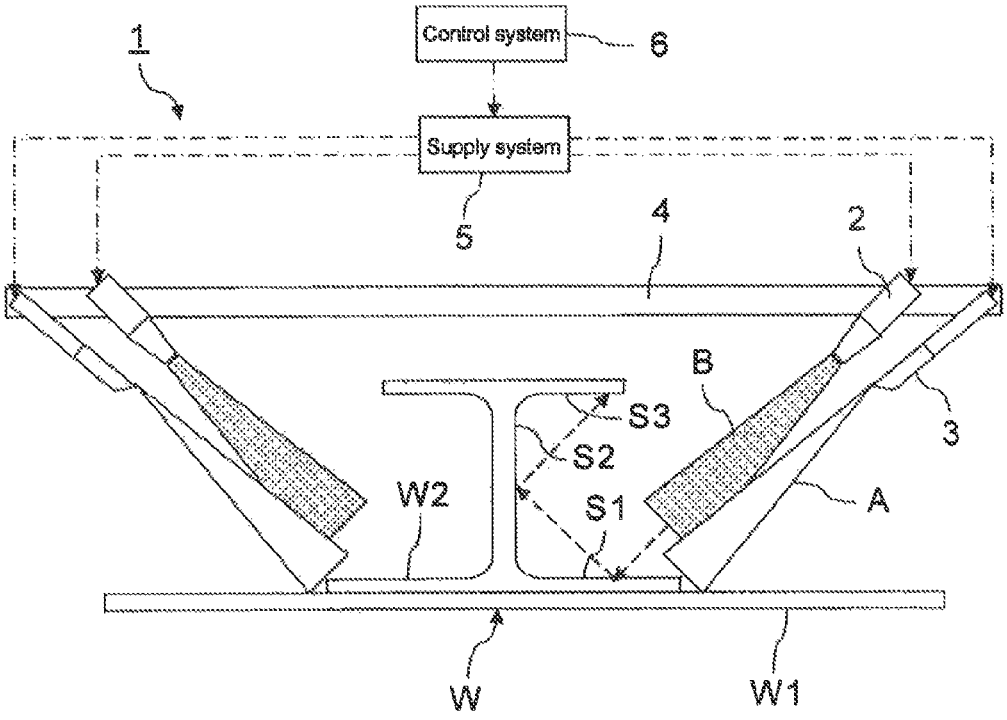
FIG. 1 is a view illustrating a configuration of a blast processing device according to a first implementation of the present invention.

FIG. 1 is a view illustrating a configuration of a blast processing device according to a first implementation of the present invention.

A blast processing device 1 is a device for manufacturing a blasted product by blasting a blasting material B onto a workpiece W serving as the workpiece of the present invention. For this purpose, the blast processing device 1 is configured such that a blast nozzle 2 serving as the first nozzle and an air assist nozzle 3 serving as the second nozzle are provided on a moving mechanism 4.

The blast nozzle 2 blasts the blasting material B toward the workpiece W using first compressed air. The blasting material B is typically constituted by hard particles such as steel grit, steel shot, cut wire, alumina, glass beads, or silica sand.

The air assist nozzle 3, meanwhile, blasts assist air A as second compressed air in order to adjust a diffusion range of the blasting material B. Accordingly, the blast nozzle 2 and the air assist nozzle 3 are connected by pipes to a supply system 5 that supplies the blasting material B, the first compressed air used to blast the blasting material B, and the second compressed air serving as the assist air A.

The supply system 5 is controlled by a control system 6. More specifically, an amount of the blasting material B, a pressure, a flow velocity, and a flow rate of the first compressed air, and a pressure, a flow velocity, and a flow rate of the second compressed air can be adjusted through control executed on the supply system 5 by the control system 6.

The moving mechanism 4 is a device for moving the blast nozzle 2 and the air assist nozzle 3 over the workpiece W. In the illustrated example, the workpiece W is an aircraft component in which a stringer W2 having an I-shaped cross-section is attached to a plate-shaped panel W1. Hence, a movement direction of the blast nozzle 2 and the air assist nozzle 3 corresponds to a lengthwise direction of the stringer W2. Further, a front surface of the panel W1 and respective inner surfaces of the stringer W2 constitute blasted surfaces to be subjected to blast processing.

More specifically, the blasted surfaces of the stringer W2 are a first blasted surface S1, a second blasted surface S2, and a third blasted surface S3. The first blasted surface S1 is substantially parallel to the front surface of the panel W1. The second blasted surface S2 is orthogonal to the first blasted surface S1. The third blasted surface S3 is orthogonal to the second blasted surface S2.

Further, the cross-section of the stringer W2 exhibits line symmetry, and therefore the blasted surfaces appear on either side thereof. Hence, two blast nozzles 2 and two air assist nozzles 3 are attached to the moving mechanism 4 in accordance with the shape of the stringer W2. Needless to say, a stringer having an asymmetrical cross-section or a stringer not having an I-shaped cross-section may also be subjected to blast processing. In this case, the blast nozzle 2 and the air assist nozzle 3 are to be provided in appropriate numbers and disposed in appropriate positions in accordance with the shape of the workpiece W.

The blast nozzle 2 is configured to blast the blasting material B against the first blasted surface S1 of the workpiece W from a diagonal direction so that the blasting material B that impinges on and bounces off the first blasted surface S1 impinges on the second blasted surface S2 of the workpiece W, which is inclined relative to the first blasted surface S1. For example, the blasting material B may be blasted from a direction having a 45 degree incline relative to the first blasted surface S1.

By setting conditions such as the blasting direction of the blasting material B and the pressure of the first compressed air used to blast the blasting material B appropriately, the blasting material B that impinges on and bounces off the second blasted surface S2 of the workpiece W can then be caused to impinge on the third blasted surface S3, which is inclined relative to the second blasted surface S2, as illustrated in the drawing.

The air assist nozzle 3, meanwhile, has a slit-shaped ejection port. The air assist nozzle 3 is configured such that when the assist air A is blasted through the slit, a film of the assist air A is formed at an incline relative to the first blasted surface S1. Hence, diffusion of the blasting material B in an inappropriate direction can be suppressed by the film of the assist air A. The assist air A can be blasted from a direction having a 40 degree incline relative to the first blasted surface S1, for example.

Conditions such as the pressure, flow velocity, and flow rate of the assist air A blasted from the air assist nozzle 3 in particular can be controlled by the control system 6. As a result, the diffusion range of the blasting material B can be adjusted variably so as to remain within an appropriate range.

(Operation and Actions)

Next, a blast processing method using the blast processing device 1 will be described.

First, positioning is performed by driving the moving mechanism 4 to move the blast nozzle 2 and the air assist nozzle 3 to appropriate positions for blasting the workpiece W.

Next, under the control of the control system 6, the assist air A is supplied to the air assist nozzle 3 from the supply system 5 at a predetermined pressure, a predetermined flow velocity, and a predetermined flow rate. As a result, the assist air A for adjusting the diffusion range of the blasting material B is blasted from the air assist nozzle 3. The ejection port of the air assist nozzle 3 is slit-shaped. Therefore, a film of the assist air A is formed at an incline relative to the first blasted surface S1.

Meanwhile, under the control of the control system 6, the blasting material B and the first compressed air are supplied to the blast nozzle 2 from the supply system 5. Typically, the blasting material B is intermixed with the first compressed air in the vicinity of the blast nozzle 2. As a result, the blasting material B is blasted toward the workpiece W from the blast nozzle 2 by the first compressed air.

The blasted blasting material B impinges on and bounces off the first blasted surface S1 forming an inner surface of the stringer W2. The blasting material B that impinges on and bounces off the first blasted surface S1 impinges on and bounces off the second blasted surface S2 forming another inner surface of the stringer W2. Further, as long as conditions are appropriate, the blasting material B that impinges on and bounces off the second blasted surface S2 impinges on the third blasted surface S3 forming a further inner surface of the stringer W2. As a result, a region of the stringer W2 on which the blasting material B impinges is blasted.

Furthermore, the moving mechanism 4 is driven to move the blast nozzle 2 and the air assist nozzle 3 over the workpiece W. In other words, the blast nozzle 2 and the air assist nozzle 3 move in the lengthwise direction of the stringer W2. As a result, the inner surfaces of the stringer W2 are blasted in sequence in the lengthwise direction, whereby a blasted product is manufactured as the blasted workpiece W.

In other words, with the blast processing device 1 described above, by blasting the assist air A separately from the blasting material B so that the diffusion range of the blasting material B is set as an appropriate range, a plurality of surfaces, such as the inner surfaces of the stringer W2, can be blasted simultaneously and efficiently.

(Effects)

According to the blast processing device 1, therefore, a plurality of surfaces can be blasted simultaneously under more favorable conditions. More specifically, diffusion of the blasting material B in a different direction to the blasted surfaces of the workpiece W can be suppressed by the air curtain formed by the assist air A. As a result, the blasting material B can be guided to the blasted surface side of the workpiece W.

Accordingly, an amount of blasting material B required to impinge on the blasted surfaces of the workpiece W can be secured. As a result, blast processing for the purpose of activation or the like of the front surface of the workpiece W can be performed efficiently.

Furthermore, the blast nozzle 2 and the air assist nozzle 3 can be constituted by general-purpose nozzles. In particular, the blasting port of the blast nozzle 2 has an isotropic shape, and therefore wear occurring on the blast nozzle 2 when the blasting material B is blasted can be reduced in comparison with a special nozzle having an anisotropic blasting port. In other words, wear on the blast nozzle 2 can be made equal to wear occurring on an existing general-purpose nozzle.

Hence, blast processing can be performed efficiently and automatically not only on a steel material having an I-shaped or H-shaped cross-section, but also on a workpiece having a complicated structure, such as an aircraft component or a ship component. Further, blast processing can be performed for the purpose of priming processing performed during painting or the like and surface processing such as paint stripping and shot peening.

(Second Implementation)

Figure 2:
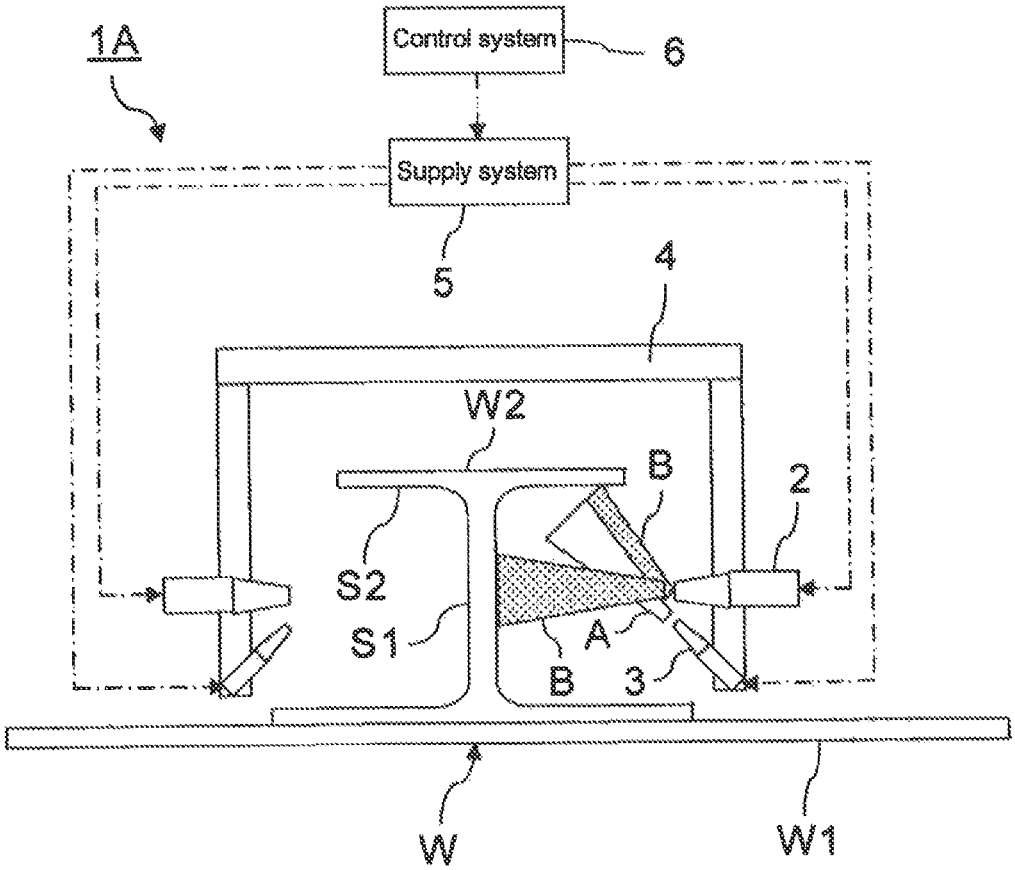
FIG. 2 is a view illustrating a configuration of a blast processing device according to a second implementation of the present invention.

FIG. 2 is a view illustrating a configuration of a blast processing device according to a second implementation of the present invention.

A blast processing device 1A according to the second implementation, illustrated in FIG. 2, differs from the blast processing device 1 according to the first implementation, illustrated in FIG. 1, in that the assist air A is blasted in order to widen the diffusion region of the blasting material B. All other configurations and actions of the blast processing device 1A according to the second implementation are substantially identical to the blast processing device 1 according to the first implementation. Therefore, identical configurations have been allocated identical reference symbols, and description thereof has been omitted.

In the blast processing device 1A, the blast nozzle 2 serving as the first nozzle is configured to blast the blasting material B toward the first blasted surface S1 of the workpiece W.

The air assist nozzle 3 serving as the second nozzle, on the other hand, is configured to widen the diffusion range of the blasting material B by blasting the second compressed air as the assist air A. More specifically, the air assist nozzle 3 is configured to vary the blasting direction of at least a part of the blasting material B blasted toward the first blasted surface S1 from the blast nozzle 2 such that the blasting material B is oriented toward the second blasted surface S2, which has a different normal direction to the first blasted surface S1, by blasting the assist air A. As a result, the diffusion range of the blasting material B can be widened to a range oriented toward both the first blasted surface S1 and the second blasted surface S2.

In the illustrated example, the workpiece W is the I-shaped stringer W2, and therefore the blast nozzle 2 is disposed such that the blasting material B is blasted in a horizontal direction. The air assist nozzle 3, meanwhile, is disposed in the vicinity of the blast nozzle 2. An orientation of the air assist nozzle 3 is adjusted so that a part of the blasting material B can be oriented toward the second blasted surface S2 by blasting the assist air A. Accordingly, the moving mechanism 4 has a portal-shaped structure.

Note that the diffusion range of the blasting material B may be adjusted variably not only by adjusting the orientation of the air assist nozzle 3, but also by controlling conditions such as the pressure, flow velocity, and flow rate of the assist air A blasted from the air assist nozzle 3 using the control system 6.

Figure 3:
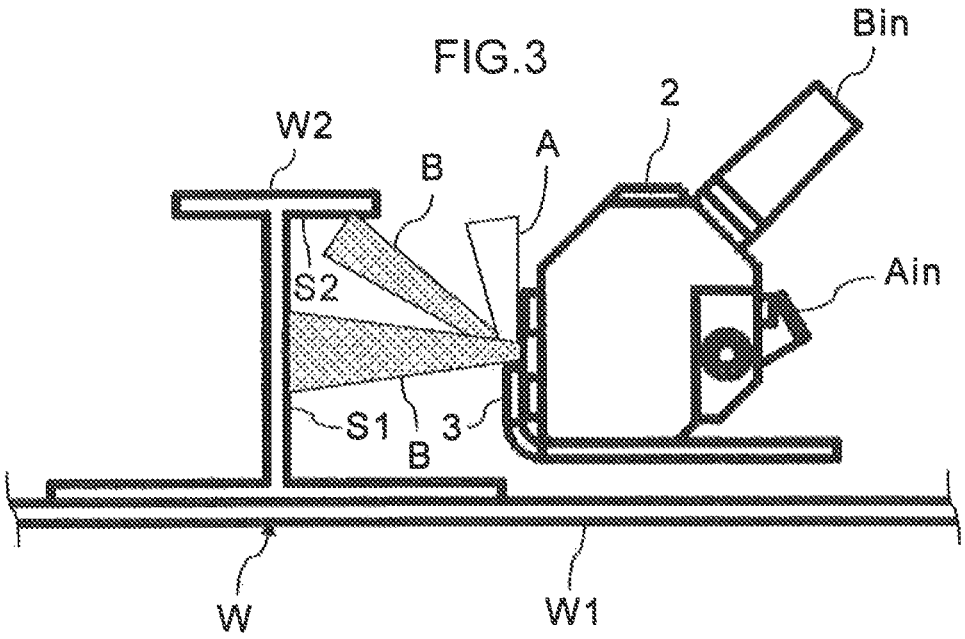
FIG. 3 is a front view illustrating preferred structural examples of a blast nozzle and an air assist nozzle illustrated in FIG. 2.
Figure 4:
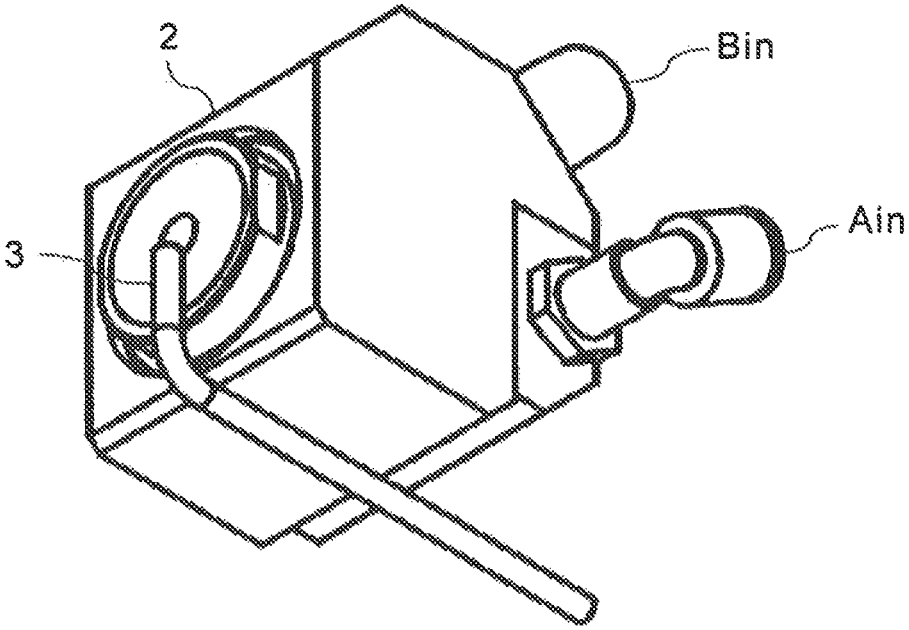
FIG. 4 is a perspective view of the blast nozzle and the air assist nozzle illustrated in FIG. 3.
Figure 5:
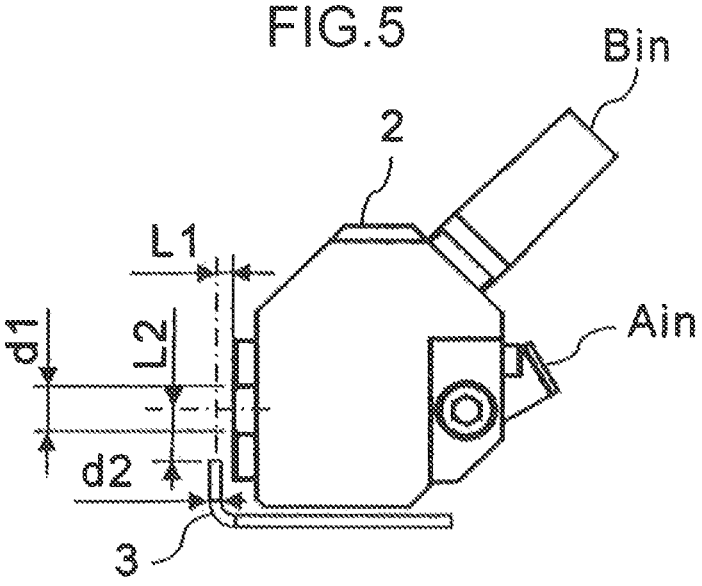
FIG. 5 is a front view illustrating definitions of parameters for determining the structure of the blast nozzle and the air assist nozzle illustrated in FIG. 3.
Figure 6:
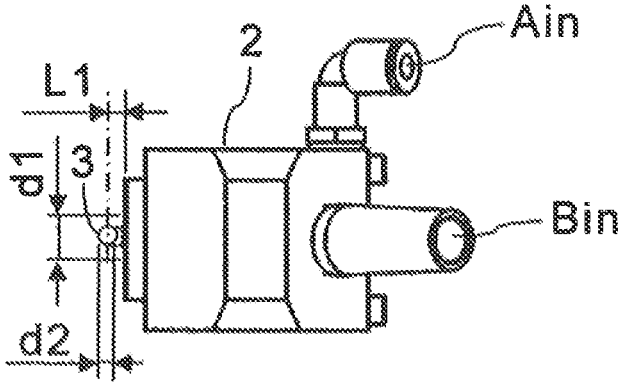
FIG. 6 is a top view illustrating definitions of the parameters for determining the structure of the blast nozzle and the air assist nozzle illustrated in FIG. 3.

FIG. 3 is a front view illustrating preferred structural examples of the blast nozzle 2 and the air assist nozzle 3 illustrated in FIG. 2. FIG. 4 is a perspective view of the blast nozzle 2 and the air assist nozzle 3 illustrated in FIG. 3. FIG. 5 is a front view illustrating definitions of parameters for determining the structure of the blast nozzle 2 and the air assist nozzle 3 illustrated in FIG. 3. FIG. 6 is a top view illustrating definitions of the parameters for determining the structure of the blast nozzle 2 and the air assist nozzle 3 illustrated in FIG. 3.

As illustrated in FIGS. 3 and 4, the air assist nozzle 3 is preferably configured such that the assist air A is blasted toward an outlet of the blast nozzle 2 from a different direction to the direction in which the blasting material B is blasted from the blast nozzle 2. In other words, the diffusion range of the blasting material B can be widened effectively by applying the assist air A thereto before the blasting material B diffuses.

Hence, in the example illustrated in FIGS. 3 and 4, the air assist nozzle 3 is attached to the blast nozzle 2 to form an integral structure. Note that the blast nozzle 2 is provided with a supply port Bin for the blasting material B and a supply port Ain for the first compressed air used to blast the blasting material B. The blasting material B is intermixed with the first compressed air in the vicinity of the blasting port of the blast nozzle 2.

More specifically, as illustrated in FIGS. 5 and 6, it was confirmed in an actual blast processing test that it is extremely effective to dispose the blast nozzle 2 and the air assist nozzle 3 such that a relationship of $d2/2 \leq L1 \leq 5 \times d2$ and a relationship of $d1/2 \leq L2 \leq 4 \times d1$ are established, where d1 is an inner diameter of the blast nozzle 2, d2 is an inner diameter of the air assist nozzle 3, L1 is a distance between a central axis of the air assist nozzle 3 and a tip end of the blast nozzle 2, and L2 is a distance between a central axis of the blast nozzle 2 and a tip end of the air assist nozzle 3.

The diffusion range of the blasting material B can also be widened by configuring the blast nozzle 2 and the air assist nozzle 3 such that a relationship of $d2<d1$ is established. In other words, when the inner diameter d2 of the air assist nozzle 3 is made smaller than the inner diameter d1 of the blast nozzle 2, the blasting direction of a part of the blasting material B blasted toward the first blasted surface S1 from the blast nozzle 2 can be varied so as to be oriented toward the second blasted surface S2 by blasting the assist air A.

In particular, by blasting the assist air A, the blasting material B blasted toward the first blasted surface S1 can be bifurcated. When, in this case, the moving mechanism 4 is driven in the lengthwise direction of the I-shaped stringer W2, the first blasted surface S1 is blasted twice. As a result, a reliable blasting effect can be obtained in relation to the first blasted surface S1.

Note that when only the second blasted surface S2 serving as an upper side inner surface of the I-shaped stringer W2 is to be subjected to blast processing, the inner diameter d1 of the blast nozzle 2 and the inner diameter d2 of the air assist nozzle 3 may be determined such that a relationship of $d2 \geq d1$ is established. In other words, the inner diameter d1 of the blast nozzle 2 may be set to be equal to or smaller than the inner diameter d2 of the air assist nozzle 3. In this case, almost all of the blasting material B blasted toward the first blasted surface S1 is oriented toward the second blasted surface S2. In other words, instead of widening the diffusion range of the blasting material B by blasting the assist air A, a diffusion direction of the blasting material B can be varied by blasting the assist air A.

As illustrated in FIGS. 3 and 4, regardless of whether the diffusion range of the blasting material B is to be widened or the diffusion direction of the blasting material B is to be varied, it is efficient to configure the air assist nozzle 3 such that when the air assist nozzle 3 is projected, the assist air A is blasted in a direction that may be considered orthogonal to the direction in which the blasting material B is blasted from the blast nozzle 2.

By determining the orientation of the air assist nozzle 3 in this manner, energy loss in the assist air A can be minimized. In addition, by controlling conditions such as the pressure, flow velocity, and flow rate of the assist air A using the control system 6, the variably adjustable diffusion range of the blasting material B can be widened. In other words, the diffusion direction of a part of the blasting material B can ideally be bent by 90 degrees.

With the blast processing device LA according to the second implementation, described above, similar effects to the blast processing device 1 according to the first implementation can be obtained. In addition, the blast nozzle 2 and the air assist nozzle 3 can be constituted by general-purpose nozzles. In particular, the air assist nozzle 3 can likewise be constituted by a nozzle having an isotropic blasting port.

Further, as illustrated in FIGS. 3 and 4, by blasting the assist air A toward the outlet of the blast nozzle 2 such that the assist air A reaches the blasting material B prior to diffusion, the diffusion direction of the blasting material B can be controlled easily. In other words, the diffusion range of the blasting material B can be adjusted by the assist air A blasted under realistic conditions.

(Other Implementations)

Specific implementations were described above, but the described implementations are merely examples, and the scope of the present invention is not limited thereto. The novel method and device described herein may be realized in various other forms. Further, various omissions, replacements, and modifications may be implemented on the method and device described herein within a scope that does not depart from the spirit of the invention. These various forms and modified examples are assumed to be within the scope and spirit of the invention, and are therefore included in the attached claims and their equivalents.

The invention claimed is:

1. A blast processing device comprising:

a first nozzle that blasts a blasting material toward a workpiece using first compressed air;

a second nozzle that blasts second compressed air for adjusting a diffusion range of the blasting material; and a moving mechanism that moves the first nozzle and the second nozzle over the workpiece, wherein the first and second nozzles are configured such that the second nozzle blasts the second compressed air to bifurcate the blasting material blasted from the first nozzle such that at least a first part of the blasting material blasted from the first nozzle is blasted toward a first region of the workpiece and at least a second part of the blasting material blasted from the first nozzle is blasted toward a second region of the workpiece.

2. The blast processing device according to claim 1, wherein the second nozzle blasts the second compressed air toward an outlet of the first nozzle from a direction different from a direction in which the blasting material is blasted from the first nozzle.

3. The blast processing device according to claim 1, wherein the second nozzle expands a diffusion range of the blasting material by blasting the second compressed air.

4. The blast processing device according to claim 1, wherein the first region of the workpiece is a first surface of the workpiece, and the second region of the workpiece is a second surface of the workpiece, the second surface having a normal direction different from a normal direction of the first surface, whereby the diffusion range of the blasting material is expanded to a range oriented toward both the first surface and the second surface.

5. The blast processing device according to claim 1, wherein the second nozzle blasts the second compressed air in a direction orthogonal to a direction in which the blasting material is blasted from the first nozzle.

6. The blast processing device according to claim 5, wherein the first nozzle and the second nozzle are disposed such that a relationship of $d2/2 \leq L1 \leq 5 \times d2$ is established, where d2 is an inner diameter of the second nozzle and L1 is a distance between a central axis of the second nozzle and a tip end of the first nozzle.

7. The blast processing device according to claim 6, wherein the first nozzle and the second nozzle are disposed such that a relationship of $d1/2 \leq L2 \leq 4 \times d1$ is established, where d1 is an inner diameter of the first nozzle and L2 is a distance between a central axis of the first nozzle and a tip end of the second nozzle.

8. The blast processing device according to claim 5, wherein the first nozzle and the second nozzle are disposed such that a relationship of $d1/2 \leq L2 \leq 4 \times d1$ is established, where d1 is an inner diameter of the first nozzle and L2 is a distance between a central axis of the first nozzle and a tip end of the second nozzle.

9. The blast processing device according to claim 1, further comprising a control system that variably adjusts the diffusion range of the blasting material by controlling at least one blasting condition of either the first nozzle or the second nozzle.

10. The blast processing device according to claim 9, wherein the at least one condition controlled by the control system for variably adjusting the diffusion range of the blasting material blasted from the first nozzle comprises at least any one of: an amount of the blasting material blasted by the first compressed air, a pressure of the first compressed air, a flow velocity of the first compressed air, a flow rate of the first compressed air, a pressure of the second compressed air, a flow velocity of the second compressed air, and a flow rate of the second compressed air.

11. The blast processing device according to claim 1, wherein the first nozzle and the second nozzle are configured such that a relationship of $d2<d1$ is established, where d1 is an inner diameter of the first nozzle and d2 is an inner diameter of the second nozzle.

12. The blast processing device according to claim 1, wherein an orientation of the second compressed air blasted from the second nozzle is adjustable for variably adjusting the diffusion range of the blasting material blasted from the first nozzle.

13. The blast processing device according to claim 1, wherein the second nozzle blasts the second compressed air such that the second compressed air reaches the blasting material blasted from the first nozzle prior to diffusion of the blasting material.

14. The blast processing device according to claim 1, wherein a central axis of the second nozzle intersects a central axis of the first nozzle at a position between the workpiece and the first nozzle.

15. The blast processing device according to claim 1, wherein a central axis of the second nozzle intersects a central axis of the first nozzle at a position that is upstream, in a blast material flow, from a point of contact of the blast material flow with the workpiece.

16. A blast processing method for manufacturing a blasted product comprising: utilizing the blast processing device according to claim 1.

17. A blast processing method for manufacturing a blasted product comprising:

utilizing a blast processing device comprising:

a first nozzle that blasts a blasting material toward a workpiece using a first gas;

a second nozzle that blasts a second gas for adjusting a diffusion range of the blasting material; and a moving mechanism that produces a relative movement between the workpiece and the first and second nozzles, the method further comprising blasting the blasting material at a first surface of the workpiece in such a manner that blasting material impinges on and deflects off the first surface and then impinges on a second surface of the workpiece, the second surface being inclined relative to the first surface.

18. The blast processing method according to claim 17, wherein the second nozzle of the blast processing device utilized blasts the second compressed air through a slit such that a film of the second compressed air is formed at an incline relative to a surface of the workpiece, whereby diffusion of the blasting material is suppressed in at least one direction by the film of the second compressed air.

* * * * *